US005951397A

United States Patent [19]

Dickinson

[11] Patent Number: 5,951,397

[45] Date of Patent: Sep. 14, 1999

[54] GAMING MACHINE AND METHOD USING TOUCH SCREEN

[75] Inventor: Peter D. Dickinson, Reno, Nev.

[73] Assignee: International Game Technology, Reno, Nev.

[21] Appl. No.: 07/918,964

[22] Filed: Jul. 24, 1992

[51] Int. Cl.[6] ..... A63F 9/22

[52] U.S. Cl. ..... 463/36; 273/143 R; 463/20; 463/16; 463/13; 463/12

[58] Field of Search ..... 273/138 A, 85 CP, 273/269, DIG. 28, 143 R; 463/20, 16, 13, 12

[56] References Cited

U.S. PATENT DOCUMENTS

| | | | |
|---|---|---|---|
| 4,856,787 | 8/1989 | Itkis | 273/269 |
| 5,042,809 | 8/1991 | Richardson | 273/138 A |
| 5,224,706 | 7/1993 | Bridgeman et al. | 273/85 CP |
| 5,263,716 | 11/1993 | Smyth | 273/143 R |
| 5,342,047 | 8/1994 | Heidel et al. | 273/85 CP |

FOREIGN PATENT DOCUMENTS

| | | | |
|---|---|---|---|
| 2147773 | 5/1985 | United Kingdom | 273/138 A |
| 8101664 | 6/1981 | WIPO | 273/138 A |

OTHER PUBLICATIONS

"Advanced CRT Screen", Playmeter, Aug. 1982, p. 80.

*Primary Examiner*—Michael O'Neill
*Attorney, Agent, or Firm*—Townsend and Townsend and Crew

[57] ABSTRACT

An improved gaming machine having a touch screen applied to an outer face of a CRT display and a limited number of push-button actuators. Either the touch screen or the push-button actuators can be used for controlling play as well as selecting one of several games that can be played on the machine. By using a touch screen on the video display device, the player of the game of the machine can use either the touch screen or the push-button actuators to change the playable game elements, such as discarding and drawing new cards when playing poker. The touch screen and associated electronics are arranged and programmed so that multiple touch fields are defined on the surface of the screen, which, by manually touching, can be used for playing games, such as keno, which require more actuators than there are push buttons on the machine. The touch fields on the touch screen are identified by generating appropriately located instruction images on the CRT display, which are visible through the transparent touch screen. The touch screen is directly applied; e.g. bonded, to the CRT screen.

42 Claims, 1 Drawing Sheet

GAMING MACHINE AND METHOD USING TOUCH SCREEN

This invention relates to improvements in electronic machines for playing games, such as poker, blackjack and the like, and more particularly, to an improved apparatus and method for electronically playing a gaming machine.

BACKGROUND OF THE INVENTION

Electronic gaming machines have been known and used for a number of years. For the most part, such gaming machines are used for playing poker, blackjack, video slots and the like. Typically, these machines have a CRT display device which flashes and presents images of cards or other playable game elements for viewing by a player of the machine.

The player generally operates push-button actuators which include hold/deal buttons and deal/draw buttons if, for instance, the machine is a poker machine. Similar push buttons are provided for playing blackjack and video slots.

The electronic machines of the type mentioned are limited in the number of games that can be played with them; namely, poker, blackjack and video slots. Keno is generally not playable with such electronic gaming machines because keno requires too many push-button actuators for controlling the play of the game. For this reason, conventional electronic gaming machines are limited in use, and this presents a drawback when it is desired to place the machines in large casinos for maximum return. Ideally, video gaming machines should have versatility in the types and number of games that can be played with them. Thus, a need exists for improvement in gaming machines of this type to allow the machines to be able to play additional games, specifically keno, along with multiple versions of the game of poker, blackjack and video slots. The present invention satisfies this need.

SUMMARY OF THE INVENTION

The present invention is directed to an improved gaming machine and method wherein a conventional push-button operated machine is modified by including on the outer face of a CRT display device of the machine a touch screen. The touch screen is appropriately wired so that the play of the game can be controlled with it or with the push-button actuators.

The machine is generally of the type well known in the gaming industry as the Players Edge Series, a group of machines each of which includes a CRT display device which presents images of the cards or playable game elements in such a way that the player of the machine can actuate push buttons to change the playable game elements so as to try to obtain an advantage over a reference hand, such as the hand of a dealer. Such machines are commercially available from International Game Technology, or IGT, of Reno, Nev. By adding a touch screen to the video display device of such machines, for example, the player can select either the touch screen or the push-button actuators to change the playable game elements such as discarding and drawing new cards.

The touch screen allows the machine to play not only multiple versions of poker, blackjack and video slots, but also keno. This was not possible with conventional video gaming machines; e.g. the Players Edge Series of IGT, because keno requires a large number of push-button actuators. Moreover, there is not enough room on conventional push-button machines for the many additional push buttons keno requires. In addition, if conventional video machines were fitted with enough push buttons to permit playing keno or similar games, the machine would resemble a computer keyboard, an undesirable feature inasmuch as the typical player has an aversion to keyboards for computers.

The touch screen thus allows a conventional video gaming machine, such as a Players Edge Series machine, to be used for playing games requiring many push buttons; e.g. keno, without increasing the number of push buttons carried by the machine and, thereby, without rendering it functionally or aesthetically less desirable.

With the touch screen, the player has the option of selecting one of several or many different games, and this can be done by way of the touch screen when the initial selection video comes up on the video display of the CRT display device. The push-button actuators and the touch screen are wired so that game selection is possible with one or the other.

Furthermore, by fitting a conventional video machine with a touch screen, one can accomplish what previously required at least two separate machines. There is only an added cost of approximately $500.00 for the touch screen, its functional integration (e.g. wiring) with the remainder of the machine, and the additional game software. In contrast, adding a second machine to permit keno play, for example, costs about $5,000.00 and roughly doubles the casino floor space requirements. Thus, the cost of separate poker and keno machines exceeds the added cost of a combination machine using a touch screen and the conventionally limited number of pushbutton actuators by a factor of about 10:1. In addition, there is the added, ongoing doubling of the floor space costs one necessarily encounters when using two conventional machines instead of the combination machine of the present invention.

To enhance the versatility of usefulness of the combination touch screen-push button machines of the present invention, they can be fitted with otherwise conventional coin acceptor slots, bill acceptors, debit/credit card reception systems and ticket printers. Ticket printers are especially suitable for the increasingly common lottery systems where machines are installed in public places, such as stores, restaurants or bars, and where the establishment owner pays the winnings on the basis of the tickets being printed by the machine.

A primary object of the present invention therefore is to provide an improved gaming machine and method of playing video gaming machines in which a touch screen is applied to the outer face of a CRT display device, which can be used instead of or in addition to push buttons for playing any one of a number of different games, including all types of poker games and/or keno, to thereby render the machine more versatile and more profitable over a long period of time.

Other objects of this invention will become apparent as the following specification progresses, reference being made to the accompanying drawing for an illustration of the invention.

DETAILED DESCRIPTION OF THE PREFERRED EMBODIMENT

Figure 1:
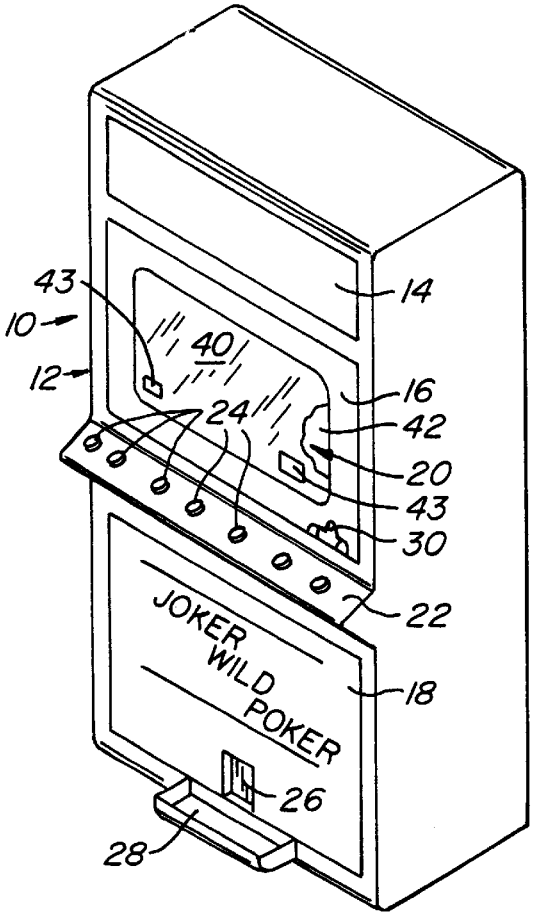
FIG. 1 is a front elevational perspective view of a conventional housing for a gaming machine constructed in accordance with the present invention and having a CRT display device with a touch screen and a bank of push-button actuators for controlling the play of the game with the machine.
Figure 2:
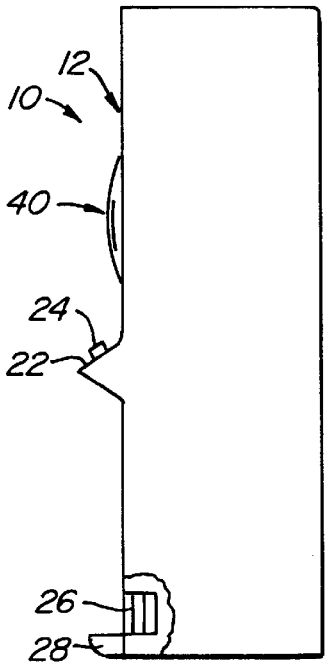
FIG. 2 is a side elevational view of the machine of FIG. 1.

The gaming machine of the present invention is broadly denoted by the numeral 10 and includes an outer housing 12 having a top door 14, central opening 16 and a bottom door 18. The housing is generally upright as shown in FIG. 1 and is adapted to be used to play a number of games, such as poker, blackjack and video slot machine. The machine includes a CRT display device 20 which is fitted with a touch screen 40, described in greater detail below. The housing further has a limited number; e.g. eight, push buttons 24. The touch screen is provided to enable play of games, such as keno, for example, which are not generally playable with the machine because keno needs many more push-button actuators that can be conveniently positioned on the machine.

The top door 14 can be opened to allow entry to a space in the machine 10 for mounting the required equipment, such as electronic circuitry, of the machine. The central opening 16 carries the CRT display device 20 on which images of cards and/or other indicia of games playable on the machine are displayed.

Near the lower margin of main opening 16, a number of push buttons or push-button actuators 24 are mounted on a ledge 22 for access by the player of the machine. For poker there are typically five "hold/cancel" buttons (one for each card displayed on the screen), in some jurisdictions also referred to as "remove/recall" buttons, a deal/draw button, preferably on the right-hand side of the machine, a bet-one credit button, and a bet-maximum credit button, for a total of eight push buttons.

The lower door 18 typically carries advertising material and is preferably backlit with lights on the inside of the housing to make the machine more attractive and aesthetically appealing to would-be players. The machine may have a coin acceptor slot 30 into which the desired number of betting coins can be inserted before play commences and a coin receiving tray 28 for receiving coins ejected by the machine when a winning hand is displayed on the screen, the coins exiting the machine through a chute 26 for flow into the tray. Alternatively, the machine may dispense a printed ticket representing the player's winnings.

Ledge 22, on which push buttons 24 are mounted, is conventionally located and designed to provide the player with maximum comfort and convenience. Thus, it is located relative to the player, who typically sits on an elevated chair in front of the machine, so that the player's forearm is only slightly upwardly inclined while his upper arm remains proximate the player's torso. In other words, the ledge is positioned in front of the player and not too high. Such a positioning of the ledge limits or prevents fatigue in the player's arm and therefore makes it possible for him to remain in the playing position for relatively long periods of time. For convenience of play, as well as for aesthetic reasons, there are only a limited number; e.g. eight, of push buttons on the ledge, which is sufficient for playing most casino games such as a variety of poker games, blackjack (21), video slot games (displaying images of rotating reels with a variety of symbols on the CRT screen), and similar games.

A machine with the foregoing features is conventional and can be obtained, for example, as a standard video poker machine from IGT of Reno, Nev.

To enhance the versatility of such a machine, the present invention applies a touch screen 40 to the front outer surface 42 of the CRT display device 20. Touch screens are commercially available from a variety of sources. Briefly, a touch screen is a transparent; e.g. glass, panel which is curved and shaped to correspond to the curvature and shape of the CRT screen surface to which it is applied. One type of touch panel is fitted with a number of relatively short; e.g. one-inch or so in length, mostly linear, spaced-apart electrodes arranged in one to three spaced-apart, peripheral lines along the perimeter of the touch screen. Such commercially available touch screens are typically delivered with a controller board (not shown) which includes a touch screen processor, an A/D converter and other electronic components which are appropriately connected with the electrodes so that the location at which a person touches the screen can be sensed by the electrodes and a corresponding signal is generated which can be further processed. The signal can then be used to execute specific commands for playing a game. A message is generated by the CRT display beneath to inform the player of the command he sends if he touches the screen at that location.

Figure 3:
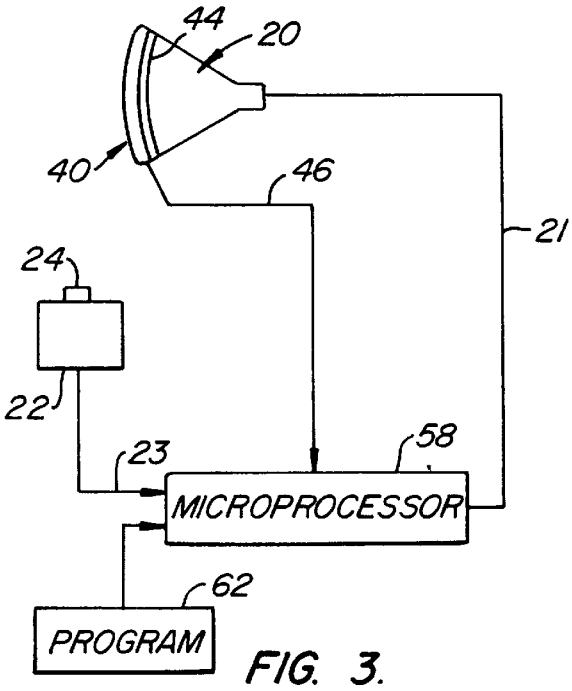
FIG. 3 is a block diagram of the circuitry showing the CRT display device with a touch screen attached thereto and the circuitry in block diagram form for coupling the push-button actuators and the touch screen with the CRT display.
Figure 4:
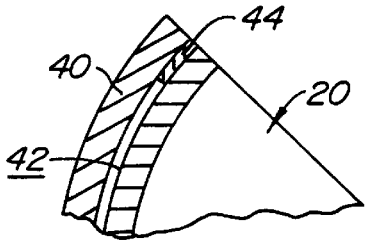
FIG. 4 is an enlarged, fragmentary cross-section through a CRT screen to which a touch screen has been applied in accordance with the present invention.

In accordance with the present invention, touch screen 40 is secured to the outer CRT screen surface 42. Preferably it is secured to the CRT screen with an adhesive or epoxy layer 44 applied between the CRT and the touch screen along their common peripheries as is illustrated in FIGS. 3 and 4.

The touch screen is transparent so that images displayed on the CRT screen are visible through it.

When the combination machine of the present invention is in use, any desired number of touch fields or soft switches 43 (only two such touch fields are illustrated in FIG. 1) are visible through the touch screen. The touch fields may include a variety of commands; e.g. for optionally increasing a bet, or for exercising play action options; e.g. selecting keno numbers. The touch screen electronics is programmed so that when a player touches a given field, the machine responds accordingly. For example, for playing keno, the touch fields displayed on the screen equal the number of keno numbers; e.g. 80, plus a number of touch fields; e.g. 5, for the requisite play commands. To play the game, the player touches the fields which correspond to the numbers he wishes to select. The touch screen electronics senses each touch and generates a corresponding signal which identifies the field, and therewith the "number" selected by the player. The signals are then fed to the electronics package of the gaming machine, which compares these "numbers" to the keno numbers randomly selected by the machine to determine whether the numbers selected by the player constitute a winning combination. If they do, the machine then conventionally ejects the winnings through chute 26 into tray 28 for collection by the player. If they do not, the play is over and a new play can commence.

To enhance the versatility of the machine, the touch screen electronics and the machine electronics are preferably programmed so that the touch screen can not only be used for playing a particular game; e.g. keno, but so that all games playable on the machine; that is, specifically those games which can be played with the limited number of push buttons 24, can be optionally played on the touch screen. Further, the touch screen and the machine electronics are programmed so that before play commences, a player has the option of choosing a particular one of the multiple games that are playable on the machine. For this purpose, when the machine is in its standby or attract mode, the CRT screen will display in appropriate touch fields which games are playable on the machine. The player will therefore first select one of the games by touching the appropriate touch field on the screen. The machine electronics then displays the game in question, including touch fields for playing the game. If the selected game is one which can be played on the limited number of push buttons provided on the machine, the player has the option of playing the game by depressing the appropriate buttons or touching the appropriate soft switches displayed on the screen, or a combination of both. Selecting one or the other mode of playing the game does not affect the actual game that is being played; it merely provides the player with the option of playing on the screen or with the buttons. Of course, games for which there are insufficient buttons on the machines can only be played on the touch screen.

When playing poker, the display of the cards on the CRT screen is typically relatively large. Normally, for playing poker, the touch screen is set up so that the entire image of each card can be touched for the poker hold/discard functions. This leaves relatively little room on the touch screen for the other required play commands. In such event, the machine electronics can be constructed and programmed so that even for playing poker on the touch screen, the deal/draw buttons 24 on machine ledge 22 can be used for this function. This reduces the number of play command touch fields on the touch screen. In such an arrangement, the two right-handmost push buttons 24 illustrated in FIG. 1 are preferably designated as the deal/draw push buttons.

FIG. 3, a schematic circuit diagram, shows that the CRT display device 20 is connected with push buttons 24 and touch screen 40 for controlling play of the machine with one or the other or both. CRT display device 20 is coupled by a lead 21 via an A/D converter (not shown) to a microprocessor 58 including a game program 62. A lead 23 from push-button actuators 24 in machine ledge 22 and a lead 46 from touch screen 40 connect with microprocessor 58 for sending game playing commands to the latter.

The player of the machine now has the option of selecting one of several plays. For instance, he can select a play by way of touch screen 40 when the initial selection menu comes up on CRT device 20. The push buttons 24 and microprocessor are preferably set up so that selection can be done with them as well. With the selected game; e.g. poker, the player has three options to play it. One is by touching the appropriate touch fields or soft switches 43 displayed on the CRT/touch screen. Another option is to manipulate push buttons 24. The third is to use a combination of the push buttons and touch fields.

Typically, the player will play with the push buttons 24 all games which are playable with them because they are better liked by the average player. Reasons for this are that push-button play involves less arm fatigue as compared with playing on the touch screen, because the screen is relatively higher, requiring the player to raise his or her arm too high for playing the machine over extended periods of time. Further, most players find the electrostatic discharge feeling when touching panel 40 objectionable and/or uncomfortable. Still further, the glass of touch screen becomes easily smudged, which is accentuated by the back illumination of the screen 40, which again will cause many players to select play with the push buttons rather than on the screen whenever this is feasible.

In spite of the expected preference of most players to play games with the push buttons whenever this is possible, the combination gaming machine of the present invention significantly enhances player appeal. Video gaming machine players frequently spend hours playing on video gaming machines, especially the most popular games such as poker, blackjack or video slots. These games can be played with the buttons, thereby minimizing or eliminating player fatigue because of the advantageous positioning of the buttons relative to the player. However, a player can quickly change over to other games, including games which could not heretofore be played on conventional push-button video gaming machines, such as keno, for example, by making the appropriate selection at the end of a play without having to leave the machine and finding one on which keno, for example, can be played. Such machine change interrupts the play rhythm, distracts the player's concentration and, not infrequently, causes the player to lose interest in play altogether, which is undesirable for casino operators, who prefer to have players spend as much time as possible at continuous play. The combination touch screen-push button machine of the present invention makes this possible and is, therefore, a machine of choice for both players and gaming operators.

What is claimed is:

1. A machine for use in electronically playing a game comprising:

a CRT display device having a display surface for images;

a housing mounting the display device for viewing from a front of the machine, the housing including a forwardly protruding ledge disposed beneath the display device;

means for generating the images on the CRT display surface with the images representing playable game elements; and means coupled with said CRT device and said generating means for changing the images to thereby change the playable game elements, said changing means including at least one push-button actuator mounted on the ledge and a touch screen applied to said display device.

2. A machine as set forth in claim 1, wherein the display surface of said CRT display device is an outer face, said touch screen being secured directly to the outer face of the device.

3. A machine as set forth in claim 1, wherein said touch screen is bonded to the display face of the CRT display device.

4. An amusement machine for selectively playing a plurality of different games comprising:

a generally upright housing having a front side and including a ledge protruding from the front side and defining a downwardly and forwardly sloping ledge surface;

a CRT display mounted to the housing above the ledge and having a display surface;

a touch screen applied to the CRT display so that images generated on the display surface remain visible;

at least one push-button actuator mounted to the ledge surface, the number of push buttons being sufficient to play at least one of the plurality of different games;

first play control means operatively coupled with the push button and the CRT display for controlling play of said at least one of a plurality of different games; and second play control means operatively coupled with the touch screen and the CRT display for controlling play of at least another one of said plurality of different games.

5. An amusement machine according to claim 4 including a plurality of push-button actuators, and wherein the plurality of push-button actuators is insufficient for playing at least a second one of the games playable with the machine, and wherein the touch screen and the second play control means are configured to enable the playing of said at least second one of the games.

6. An amusement machine according to claim 4 wherein said second one of a plurality of games playable on the machine comprises keno.

7. An amusement machine according to claim 4 including a plurality of push-button actuators, and wherein the touch screen and the second play control means are configured to define a plurality of touch fields on the touch screen, each touch field being operatively connected with the second play control means for generating a specific game control command, and wherein the plurality of touch fields is greater than the plurality of push-button actuators.

8. An amusement machine according to claim 7 wherein at least one of the touch fields defined on the touch screen is operatively coupled with the second play control means for selecting a chosen one of the plurality of games playable on the machine.

9. An amusement machine according to claim 7 wherein at least one of the push-button actuators is operatively coupled with the first play control means for selecting a chosen one of the games playable with the machine.

10. An amusement machine according to claim 4 wherein the plurality of different games playable on the machine includes poker.

11. An amusement machine according to claim 10 wherein the second play control means is operatively coupled with the touch screens for playing the game of poker.

12. An amusement machine according to claim 10 wherein the first play control means is operatively coupled with the at least one push-button actuator for generating a poker play command.

13. An amusement machine according to claim 12 wherein the at least one push-button actuator for generating a poker play command comprises a push-button actuator for generating a deal/draw command.

14. An amusement machine according to claim 12 wherein the at least one push-button actuator for generating a poker play command comprises a push-button actuator for generating one of a hold/cancel and remove/recall command.

15. An amusement machine according to claim 16 wherein the at least one push button is located at a right-hand side of the housing when facing the housing.

16. A method for playing a selected one of a plurality of video games playable on a video amusement machine, the method comprising the steps of:

providing a CRT display on a front side of the machine including a display surface on which images relating to a game being played can be observed;

applying a touch screen to the display surface so that the images remain observable;

providing a plurality of push-button actuators on the machine, the number of actuators being less than the number of actuators required for playing at least one of the games playable on the machine;

positioning the push buttons forwardly of the front side of the machine on a surface of the machine which slopes downwardly;

on the touch screen defining a plurality of touch fields, the plurality of touch fields being greater than the plurality of push-button actuators on the machine;

choosing a game to be played, the choosing step comprising at least one of the steps of touching a touch field and operating a push button;

operatively connecting at least some of the touch fields and at least some of the push buttons so that commands for a given game optionally can be generated with the touch fields and the push buttons; and playing the game, the playing step being selected from the steps of touching appropriate touch fields and operating appropriate push-button actuators.

17. A method according to claim 10 wherein one of the plurality of video games playable on the video amusement machine is poker, and wherein the step of playing the game comprises the steps of manipulating at least one of the push-button actuators for generating a poker play command, and touching a plurality of touch fields on the touch screen for generating other play commands.

18. A method according to claim 7 wherein the step of manipulating the push-button actuator is performed for generating a card deal/draw command.

19. A method according to claim 17 wherein the step of manipulating the push-button actuator is performed for generating a hold/cancel or remove/recall command.

20. An amusement machine for selectively playing a plurality of different games, including the game of poker, the machine comprising:

a generally upright housing including a front side, a cut-out in an upper portion of the front side, and a ledge protruding forwardly from the front side and defining a ledge surface which is angularly inclined relative to the front side;

a CRT display mounted to the housing so that the display is visible through the cut-out, the display including a touch screen defining a plurality of touch fields, the number of fields being sufficient for playing the game of poker and at least one other game by touching selected ones of the fields;

a plurality of push-button actuators mounted to the ledge surface, the number of push buttons being sufficient so that the game of poker can be played with the push buttons; and processing means operatively coupled with the touch screen, the push buttons and the CRT display for executing play commands optionally generated by touching touch fields or depressing the push buttons and for generating images on the CRT display representing playable game elements as a function of the touch fields which have been touched and push buttons which have been depressed.

21. An amusement machine according to claim 20 wherein one of the push buttons is operatively coupled with the processing means for generating a card deal/draw command when playing poker.

22. An amusement machine according to claim 19 wherein one of the push buttons is operatively coupled with the processing means for generating a hold/cancel or a remove/recall command when playing the game of poker.

23. An amusement machine according to claim 2 wherein the ledge surface slopes downwardly and forwardly from the front side of the housing.

24. An amusement machine comprising a housing including a front side and a cut-out in the front side;

a CRT display mounted to the housing and viewable through the cut-out;

a touch screen applied to the CRT display so that images generated on the display remain visible, the touch screen defining a plurality of touch fields;

a plurality of push-button actuators mounted to the housing; and processing means operatively coupled with the touch fields, the push buttons and the CRT display for generating play commands for the game of poker and at least one other game by generating game command signals in response to touching selected ones of the touch fields or depressing selected ones of the push-button actuators and for displaying on the CRT display playable game elements in response to the touching of a touch field or the depressing of a push-button actuator, the number of push buttons and the number of touch fields being sufficient to play the game of poker with either one;

wherein the processing means optionally permits playing the game of poker with the touch screens or the push buttons.

25. An amusement machine according to claim 24 wherein the housing includes means positioning the push buttons immediately below the touch screen.

26. An amusement machine according to claim 25 wherein the push-button position means includes means for mounting the push buttons in a plane which slopes downwardly and forwardly away from the front side of the housing.

27. An amusement machine for selectivily playing a pularilty of different games, including the game of poker, the machine comprising:

a general upright housing including a front side, a cut-out in an upper portion of the front side located for convenient viewing by a user of the machine, and a ledge protruding forwarding from the from side and defining a ledge surface which is angularly inclined relative th the front side, the ledge being positioned beneath the cut-cut and so that the user of the machine positioned in front of the machine can touch the ledge surface with his upper arms proximate his torso;

a CRT display mounted th the housing so that the display is visible through the cut-out, the display including a touch screen defining a plurality of touch fields, the number of fields being sufficient for playing the game of poker and at least one other game by touching selected ones of the fields;

a plurality of push-button actuators mounted to the ledge surface, the number of push buttons being sufficient so that the game of poker can be played with the push buttons; and processing means operatively coupled with the touch screen, the push buttons and the CRT display for executing play commands optionally generated by touching touch fields or depressing the push buttons and for generating images on the CRT display representing playable game elements as a function of the touch fields which have been touched and push buttons which have been depressed;

whereby arm fatigue by the user is substantially prevented when playing a game with the push-button actuators on the ledge surface.

28. An amusement machine according to claim 27 wherein the plurality of push-button actuators is no more than eight.

29. An amusement machine according to claim 27 wherein the push-button actuators on the ledge surface are arranged in a single, substantially straight line on the surface.

30. A machine for use by a person to electronically play a game comprising:

a CRT display device having a display surface for images and adapted to be within reach of the person when the person plays the game;

means for generating the images on the CRT display surface, the images representing playable game elements; and means coupled with the CRT device and the generating means for changing the images to thereby change the playable game elements, the changing means including a touch screen applied to the CRT device and at least one push-button actuator located between the touch screen and the person playing the game.

31. An amusement machine permitting a player to electronically play a game by touching a touch screen or operating a push-button actuator, the machine comprising:

a housing;

a CRT display mounted to the housing and having a display surface;

a touch screen applied to the CRT display so that images generated on the display surface remain visible;

at least one push-button actuator mounted on the housing so that the push-button actuator is positioned between the CRT display and the player, the number of push-button actuators being sufficient to play at least some element of the game; and play control means operatively coupled with the push-button actuators, the CRT display and the touch screen permitting the player to issue game playing commands the results of which are displayed on the display surface.

32. An amusement machine according to claim 31 wherein the display surface is an upright surface.

33. An amusement machine according to claim 32 wherein the upright surface is a substantially vertical surface.

34. An amusement machine according to claim 33 wherein the housing includes a non-upright surface extending from the CRT display surface towards the player, and wherein the push-button actuator is mounted on the non-upright surface.

35. An amusement machine according to claim 31 including a housing mounting the CRT display device, the housing having a non-upright surface extending from the CRT display device towards the player, and wherein the push-button actuator is mounted on the non-upright surface.

36. An amusement machine permitting a player to play a given one of a plurality of different games, the machine comprising:

a housing;

a CRT display mounted to the housing and having a display surface;

a touch screen constructed and applied to the CRT display so that images generated on the display surface remain visible through the touch screen;

at least one push-button actuator mounted on the housing so that the push-button actuator is positioned between the CRT display and the player, the number of push-button actuators being sufficient to play at least one of the plurality of different games;

first play control means operatively coupled with the push-button actuator and the CRT display for controlling at least a portion of play of the at least one of the plurality of games; and second play control means operatively coupled with the touch screen and the CRT display for controlling play of at least another one of the plurality of different games.

37. An amusement machine according to claim 36 wherein the display surface is an upright surface.

38. An amusement machine according to claim 37 wherein the upright surface is a substantially vertical surface.

39. An amusement machine according to claim 37 wherein the housing includes a non-upright surface extending from the CRT display surface towards the player, and wherein the push-button actuator is mounted on the non-upright surface.

40. An amusement machine according to claim 36 including a housing mounting the CRT display device, the housing having a non-upright surface extending from the CRT display device towards the player, and wherein the push-button actuator is mounted on the non-upright surface.

41. A method enabling a player to comfortably play a selected one of a plurality of video games playable on a video amusement machine, the method comprising the steps of:

providing a CRT display including a display surface on which images relating to a game being played can be observed by the player;

applying a touch screen to the display surface so that the images remain observable through the touch screen;

providing at least one push-button actuator on the machine;

positioning the push-button actuator between the CRT display and the player so that the push-button actuator is accessible to the player for playing a game therewith while limiting player fatigue;

on the touch screen defining a plurality of touch fields;

choosing a game to be played, the choosing step comprising at least one of the steps of touching a touch field and operating the push-button actuator;

operatively connecting at least some of the touch fields and the at least one push-button actuator so that commands for a given game optionally can be generated with the touch fields and the push-button actuator; and playing the game, the playing step being selected from the steps of touching at least one appropriate touch field and operating the at least one push-button actuator.

42. A video gaming machine comprising:

a housing;

a plurality of game control buttons mounted on said housing;

a plurality of machine control buttons mounted on said housing;

control means, including a memory containing a plurality of games, responsive to said game control buttons and machine control buttons for controlling the gaming machine; and a touch screen video display operatively connected to said control means for displaying said games wherein said games include displays of game controls and machine controls for operating said games;

wherein said control means is responsive to either one of said game buttons and said displayed game controls to control at least a first one of said games.

* * * * *